US005096874A

United States Patent [19]

Kita

[11] Patent Number: 5,096,874

[45] Date of Patent: Mar. 17, 1992

[54] HEAT-SENSITIVE TRANSFER METHOD

[75] Inventor: Tatsuya Kita, Tokyo, Japan

[73] Assignee: Dai Nippon Insatsu Kabushiki Kaisha, Japan

[21] Appl. No.: 465,220

[22] PCT Filed: Jul. 11, 1989

[86] PCT No.: PCT/JP89/00697

§ 371 Date: Mar. 12, 1990

§ 102(e) Date: Mar. 12, 1990

[87] PCT Pub. No.: WO90/00475

PCT Pub. Date: Jan. 25, 1990

[30] Foreign Application Priority Data

Jul. 12, 1988 [JP] Japan ..... 63-173180

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

FOREIGN PATENT DOCUMENTS

| | | | |
|---|---|---|---|
| 60-232996 | 11/1985 | Japan | 503/227 |
| 63-21188 | 1/1988 | Japan | 503/227 |
| 63-67188 | 3/1988 | Japan | 503/227 |
| 63-81093 | 4/1988 | Japan | 503/227 |

*Primary Examiner*—Bruce H. Hess

*Attorney, Agent, or Firm*—Parkhurst, Wendel & Rossi

[57] ABSTRACT

The present invention concerns a heat-sensitive transfer method which performs heat-transfer recording by heating (a) a heat transfer sheet including a dye layer comprising a dye and a binder formed on a substrate, and (b) an image-receiving sheet including a receiving layer having a resin for receiving the dye migrating from the dye layer on the heat transfer sheet formed on a substrate according to an image information from the back of the heat transfer sheet with the dye layer and receiving layer being superposed on each other, whereby the dye migrates into the receiving layer. The dye for the dye layer has a dye diffusion coefficient in the receiving layer of $5\times10^{-9}$ cm$^2$/min. or higher at 120° C. when the dye is diffused by migration into the receiving layer of the image-receiving sheet. The image-receiving sheet and the heat transfer sheet are used in combination so that the saturated transfer ratio of the dye from the dye layer to the receiving layer is 40% or more at 120° C. when the dye for the dye layer is transferred to the receiving layer of the image-receiving sheet, and a combination of the above-mentioned heat transfer sheet and image-receiving sheet to be used for this method. By setting the two factors of the dye diffusion coefficient and the dye transfer ratio, the recording sensitivity can be optimized and image formation having good heat-sensitive recording density is rendered possible regardless of whether the application energy during transfer may be great or small.

11 Claims, No Drawings

HEAT-SENSITIVE TRANSFER METHOD

TECHNICAL FIELD

This invention relates to a heat-sensitive transfer method and a combination of a heat transfer sheet and an image-receiving sheet to be used for that method.

BACKGROUND ART

Heat-sensitive transfer recording has been practiced by superposing an image-receiving sheet on a heat transfer sheet having a dye layer containing a heat migratable dye provided thereon under a state where the receiving layer surface of the image-receiving sheet is opposed to the dye layer, and heating the heat transfer sheet by a heating means such as a thermal head which is controlled by electrical signals from the back of the heat transfer sheet, thereby transferring the dye in the dye layer into the receiving layer.

However, in the heat-sensitive transfer method of the prior art, it has been difficult to obtain a printed image having good storability and high recording density.

In general, the dye to be used in the dye layer on the heat transfer sheet has been selected in view of such parameters as recording sensitivity, storability, hue, and dye solubility into ink or binder resin. Among these parameters, recording sensitivity, and storability have been known in the art to have great relationships with molecular weight of the dye and sublimation temperature. For example, it has been considered that the recording sensitivity becomes higher as the molecular weight of the dye is smaller and the sublimation temperature is lower, while storability becomes better as the molecular weight of the dye is larger and the sublimation temperature is higher. From such standpoints, in the prior art, in view of the balance between the both, dyes having molecular weights of about 150 to 800, more preferably 350 to 700, have been frequently selected as desirable ones.

However, even among the dyes having molecular weights within the range of 350 to 700, there are fewer dyes than expected which can give rise to good recording sensitivity, and a dye having desirable performance has been selected and used by repeating screening from a large number of candidates of dyes under the present situation.

Also, the recording sensitivity when performing practical heat transfer is also greatly affected by the combination of the heat transfer sheet and the image-receiving sheet. That is, the combination of the dye layer and the receiving layer, for determining what combination of the receiving layer with the dye selected as described above is optimum, one having better recording sensitivity has been selected also by repeating screening from a large number of materials for formation of receiving layer under the present situation.

Thus, in the development of heat-sensitive recording materials of the prior art, the selection criterion according to dye molecular weight for judgement goodness or badness of recording sensitivity is very vague, and no combination of good materials can be obtained before repeating screening for many times as mentioned above and yet performing practically printing, whereby many difficulties have been encountered in development of heat-sensitive recording materials.

DISCLOSURE OF THE INVENTION

The present invention has been accomplished in view of the problems of the prior art as described above, and its object is to provide a heat-sensitive transfer method which ensured image formation having good storability and high printing density.

The present inventors have studied intensively the factors which determine the combination so that the recording sensitivity may be optimized in combining a heat transfer sheet and an image-receiving sheet. It consequently has been found that particularly the two factors of the dye diffusion coefficient in the receiving layer of the image-receiving sheet and the dye saturated transfer ratio from the dye layer of the heat transfer sheet to the receiving layer of the image-receiving sheet are important factors in improvement of recording sensitivity.

The heat-sensitive transfer method has been accomplished on the basis of the above finding, and more particularly is a heat-sensitive transfer method which performs heat-sensitive transfer recording by heating (a) a heat transfer sheet comprising a dye layer comprising a dye and a binder formed on a substrate, and (b) an image-receiving sheet comprising a receiving layer comprising a resin for receiving the dye migrating from the dye layer on the heat transfer sheet formed on a substrate according to an image information from the back of the heat transfer sheet with the dye layer and receiving layer being superposed on each other, whereby the dye migrates into the receiving layer. The dye constituting the dye layer of the heat transfer sheet has a dye diffusion coefficient in the receiving layer of $5\times10^{-9}$ cm$^2$/min. or higher, more preferably $1\times10^{-8}$ cm$^2$/min. or higher at 120° C. when the dye is diffused by migration into the receiving layer of the image-receiving sheet. The image-receiving sheet and the heat transfer sheet are used in combination so that the saturated transfer ratio of the dye from the dye layer to the receiving layer is 40% or more at 120° C. when the dye constituting the dye layer of the heat transfer sheet is transferred to the receiving layer of the image-receiving sheet.

Further, the combination for heat-sensitive transfer of the present invention is an assemblage for heat transfer comprising (a) a heat transfer sheet comprising a dye layer comprising a dye and a binder formed on a substrate, and (b) an image-receiving sheet comprising a receiving layer comprising a resin for receiving the dye migrating from the dye layer on the heat transfer sheet formed on a substrate for performing heat transfer recording by heating the assemblage according to an image information from the back of the heat transfer sheet with the dye layer and receiving layer being superposed on each other, whereby the dye migrates into the above receiving layer. The dye constituting the dye layer of said heat transfer sheet has a dye diffusion coefficient in the receiving layer of $5\times10^{-9}$ cm$^2$/min. or higher at 120° C. when the dye is diffused by migration into the receiving layer of the image-receiving sheet. The image-receiving sheet and the heat transfer sheet are used in combination so that the saturated transfer ratio of the dye from the dye layer to the receiving layer is 40% or more at 120° C. when the dye constituting the dye layer of the heat transfer sheet is transferred to the receiving layer of the image-receiving sheet.

BEST MODE FOR PRACTICING THE INVENTION

As mentioned above, in the heat-sensitive transfer method of the present invention, the specific feature resides in that the recording sensitivity can be optimized by measuring only the two parameters of the dye diffusion coefficient in the receiving layer of the image-receiving sheet and the saturated transfer ratio of the dye in the dye layer of the heat transfer sheet and using a combination so that these parameter may satisfy specific conditions.

The dye diffusion coefficient in the present invention uses the value measured under the condition of 120° C. according to the method (A) or (B) shown below. Measurement method (A) of dye diffusion constant:

First, (1) with the use of a laminate of 3 to 10 sheets of a receiving layer resin film (film thickness of about 3 to 10 μm) obtained by coating and drying a resin composition for formation of a receiving layer on a releasable substrate, followed by peel-off, as the receiving layer, this is placed on a substrate (synthetic paper with a thickness of 150 μm), and further (2) a dye layer film, a protective film (polyethylene terephthalate film with a thickness of 25 μm) are laminated in this order thereon. (3) On the above protective film, a plate of a foil pressing machine with the surface temperature set at a predetermined temperature is pressure contacted for a predetermined time to effect heating (for example, operated under a gauge pressure of 5 kgf/cm$^2$ by use of a 35 mm$^2$ plate of Hotnamer type S-WII, manufactured by Yamadai Bisho K.K., Japan), and (4) subsequently, the receiving layer resin films laminated are peeled off one sheet by one sheet, and each sheet is extracted with toluene and the amount of the transferred dye is measured. (5) From the obtained data of the step (4), the dye concentration distribution curve in the depth direction of the receiving layer is determined, and the diffusion coefficient is calculated on the basis of the method of Matano (Jap. J. Phys. 8, 109 (1932)). Measurement method (B) of dye diffusion coefficient:

(1) A resin composition for formation of receiving layer is coated to a film thickness on drying of 100 to 500 μm, thereby to obtain a receiving layer. (2) On the obtained receiving layer is placed a heat transfer sheet so that the dye layer is superposed on the receiving layer. (3) On the heat transfer sheet, a plate of a foil pressing machine with the surface temperature set at 110° C. pressure is contacted for a predetermined time to effect heating (for example, operated under a gauge pressure of 5 kgf/cm$^2$ by use of a 35 mm$^2$ plate of Hotnamer type S-WII, manufactured by Yamadai Bisho K.K., Japan). (4) A strip sliced in the direction perpendicular to the surface of the receiving layer is prepared. (5) The concentration distribution curve of the dye in the depth direction of the receiving layer is determined by measuring the absorbances at the predetermined positions of the above strip by means of a microscope spectrophotometer (manufactured by Olympus Kogaku Kogyo, K.K., Japan, for example, type AH2-STK), and the dye diffusion coefficient in the receiving layer is determined on the basis of the method of Matano (Jap. J. Phys. 8, 109 (1932)).

By use of the method (A) or (B), the diffusion coefficient under any condition of the receiving layer can be determined. However, according to this method, there is a tendency that the dye diffusion coefficient may be varied at the surface layer of the receiving layer and at the deepest portion in the region where the dye is transferred. Accordingly, of the region in the receiving layer where the dye is transferred, the value determined in the middle portion where the dye diffusion coefficient becomes substantially constant is defined as the dye diffusion coefficient determined by the method (A) or (B).

Measurement method of saturated transfer ratio of dye:

On the other hand, the saturated transfer ratio of the dye in the present invention defines the value measured at 120° C. according to the following method as the standard.

(1) A resin composition for formation of receiving layer is coated and dried on a substrate to prepare an image-receiving sheet, and (2) a dye layer, a protective film (polyethylene terephthalate film with a thickness of 2.5 μm) are laminated in this order thereon. (3) On the above protective film, a plate of a foil pressing machine with the surface temperature set at a predetermined temperature is pressure contacted for a predetermined time to effect heating (for example, operated under a gauge pressure of 5 kgf/cm$^2$ by use of a 35 mm$^2$ plate of Hotnamer type S-WII, manufactured by Yamadai Bisho K.K., Japan), (4) the dye transferred in the receiving layer is extracted with toluene, and the dye amount dyed is measured by spectrophotometry. (5) From the above dye layer after transfer, the remaining dye is extracted with toluene, and the dye residual amount is measured by spectrophotometry. (6) From the data of the above (4) and (5), the saturated transfer ratio (%) of the dye is calculated from the following formula:

$$\text{Saturated transfer ratio of dye} = \frac{\text{Dye amount dyed}}{\text{Dye amount dyed} + \text{Residual dye amount}} \times 100$$

The dye transfer ratio thus determined shows such change with lapse of time under a constant temperature as described below. That is, while the heating time is short, the dye transfer ratio increases with increase of heating time, and the dye transfer ratio reaches a constant value when the heating time is sufficiently long. The dye transfer ratio at this time may be considered to indicate the affinity between the dye and the receiving layer. In short, the value of the dye transfer ratio when it has reached a constant value indicates the partition ratio of the dye in the equilibrium state between the binder of the dye layer and the receiving layer. Therefore, in the case where the binder of the dye layer is the same, the affinity between the dye and the receiving layer can be said to be higher as the value of the dye transfer ratio, when it has reached a constant value, is higher. Accordingly, particularly the value of the dye transfer ratio when reaching a constant value is called saturated transfer ratio.

When the change of the dye transfer ratio with lapse of time was measured by use of various resins for formation of receiving layer as exemplified below, it was found that the dye transfer ratio stood up within one minute of heating time to become substantially constant. Accordingly, the dye transfer ratio measured at the heating time of 3 minutes is defined as the saturated transfer ratio of the dye. The condition of heating time of 3 minutes is for the purpose of convenience. The saturated transfer ratio of the dye is in any sense a value when the dye transfer ratio has reached a constant value. Therefore, the heating time is not necessarily required to be made constant because it varies according to the dyes, the binders in the dye layer or the resins for the receiving layer.

The heat transfer method of the present invention is performed by combining suitably a heat transfer sheet and an image-receiving sheet so that the dye diffusion coefficient and the saturated transfer efficiency of the dye at 120° C. based on the above-mentioned measurement methods may become values within specific values, whereby high sensitivity transfer printing can be effected.

Heat transfer sheet

The heat transfer sheet having a dye layer satisfying the conditions of the dye diffusion coefficient and the saturated transfer ratio of the dye comprises, for example, a material as described below.

It comprises a substrate sheet which has been used in the art as the substrate sheet for this kind of heat transfer sheet and a dye layer provided on said sheet. The above dye layer comprises a dye, which is transferred by melting or sublimation by heating, and a binder thereof.

The dye may preferably be a sublimable disperse dye, a sublimable oil soluble dye, or a sublimable basic dye, having a molecular weight of 150 to 800, preferably 350 to 700. These dyes are selected in view of sublimation temperature, hue, weathering resistance, solubility into ink or binder resin, etc., and may include those as shown below.

C.I. (abbreviation for chemical index, hereinafter the same) disperse yellow 51, 3, 54, 79, 60, 23, 7, 141,
C.I. disperse blue 24, 56, 14, 301, 334, 165, 19, 72, 87, 287, 154, 26,
C.I. disperse red 135, 146, 59, 1, 73, 60, 167,
C.I. disperse violet 4, 13, 36, 56, 31,
C.I. solvent violet 13,
C.I. solvent black 3,
C.I. solvent green 3,
C.I. solvent yellow 56, 14, 16, 29,
C.I. solvent blue 70, 35, 63, 36, 50, 49, 111, 105, 97, 11,
C.I. solvent red 135, 81, 18, 25, 19, 23, 24, 143, 146, 182.

As the binder of the dye layer, cellulose resins such as ethyl cellulose, hydroxyethyl cellulose, ethylhydroxyethyl cellulose, hydroxypropyl cellulose, methyl cellulose, cellulose triacetate, cellulose diacetate, or cellulose acetate butyrate, vinyl resins such as polyvinyl alcohol, polyvinyl acetal, polyvinyl pyrrolidone, polyester, polyvinyl acetate, or polyacrylamide may be used. Examples of more preferable binder are not conventional vinyl acetal resins as mentioned above, but special polyvinyl butyral resins having a molecular weight of 60000 to 200000, containing 10 to 40% by weight, preferably 15 to 30% by weight of vinyl alcohol moiety in the polyvinyl acetoacetal resin, and having a glass transition point of 60° to 110° C., preferably 70° to 110° C. With a glass transition point lower than 60° C., there may occur such phenomenon as agglomeration or precipitation of the dye, while on the other hand, if it exceeds 110° C., no sufficient sublimation of the dye can be undesirably effected. With a molecular weight lower than 60000, the binding force as the binder is insufficient, while if it exceeds 200000, the viscosity becomes too high, whereby there is a trouble during coating. If the vinyl alcohol moiety is less than 10%, the stability of the dye layer with lapse of time is insufficient, whereby agglomeration, precipitation or bleeding onto the surface cannot be avoided. On the contrary, if it exceeds 40%, sublimation of the dye is obstructed due to affinity of the polyvinyl alcohol moiety for the dye, whereby printing density is lowered.

The weight ratio of the dye to the binder in the dye layer should be desirably 0.3 or more of dye/binder, and at a ratio less than 0.3, printing density and heat sensitivity are insufficient. On the other hand, if dye/binder ratio exceeds 2.3, retentivity of the dye in the binder is insufficient, whereby storability of the heat transfer sheet is lowered. Accordingly, dye/binder ratio may be preferably 0.3 to 2.3, more preferably 0.55 to 1.5.

The dye may be desirably dissolved in the binder of the dye layer. In the sublimation transfer paper for cloth of the prior art, since the dye is dispersed in the binder, for sublimation of the dye, an energy overcoming the interaction between the dye molecules and the interaction between the dye molecule and the binder is required, resulting in lowering of heat sensitivity. With respect to this point, if the dye is dissolved in the binder, it is advantageous in heat sensitivity.

The dye layer may be formed, if necessary, with two or more layers with different dyes juxtaposed on one heat transfer sheet by selecting the dyes so that transfer may be effected to a desired hue when printed. For example, an image of natural color photograph is to be formed by repeating printing of the respective colors corresponding to the divided color signals, the hues when printed should be preferably the respective colors of cyan, magenta and yellow, and three heat transfer layers containing dyes which give such hues are juxtaposed. Alternatively, in addition to cyan, magenta and yellow, black may be further added. Also, it is preferable to provide a mark for position detection simultaneously with formation of either heat transfer layer during formation of these dye layers, because no other ink or printing step is required separately from dye layer formation.

Image-receiving sheet

On the other hand, the image-receiving sheet having the receiving layer satisfying the dye diffusion coefficient and the dye transfer ratio as described above comprises, for example, a constitution as described below. This image-receiving sheet has a receiving layer comprising the resin which satisfies the above-mentioned conditions, and this becomes the image-receiving sheet of the present invention. As examples of the resin for formation of receiving layer in the present invention, the synthetic resins as mentioned below can be used singly or as a mixture of two or more kinds:

(a) those having ester bond:
polyester resin, polyacrylic acid ester resin, polycarbonate resin, polyvinyl acetate resin, styrene-acrylate resin, vinyl toluene-acrylate resin, etc.;
(b) those having urethane bond:
polyurethane resin, etc.;
(c) those having amide bond:
(d) those having urea bond:
urea resin, etc.;
(e) those having other bonds of high polarity:
polycaprolactone resin, styrene-maleic anhydride resin, polyvinyl chloride resin, polyacrylonitrile resin, etc.

Otherwise, saturate polyester and vinyl chloride/vinyl acetate copolymer may be employed. As the vinyl chloride/vinyl acetate copolymer, those having a vinyl chloride component content of 85 to 97% by weight and a polymerization degree of about 200 to 800 is preferable. The vinyl chloride/vinyl acetate copolymer is not necessarily limited to the copolymer consisting only of vinyl chloride component and vinyl acetate component, but may also contain vinyl alcohol component, maleic acid component, etc.

The image-receiving sheet may be either one of which the sheet itself can be used as the receiving layer, or one having a receiving layer on the sheet substrate. As the sheet substrate, plastic films, synthetic papers, cellulose fiber paper, etc. may be included. As plastic films, films comprising resins of polyester, polyvinyl chloride, polypropylene, polyethylene, polycarbonate, polyamide, etc. can be used, and white films formed by addition of fillers into these films or foamed films subjected to fine foaming can also be used. As synthetic papers, those prepared by mixing polyolefin resins or other synthetic resins as the resin component with inorganic fillers, etc. and extruding the mixture, or those prepared by coating an extender pigment on the surface of films of polystyrene resin, polyester resin, polyolefin resin, etc. may be used. As the cellulose fiber papers, pure paper, coated paper, cast coated paper, synthetic rubber latex or synthetic resin emulsion impregnated paper, etc. may be used. It is also possible to use a laminate paper having a foamed film or a synthetic paper adhered to a cellulose fiber paper or film.

Also, in the case of uses requiring transparency of image-receiving sheet, the image-receiving sheet may be constituted by providing a transparent receiving sheet on a transparent sheet substrate.

Also, in the case of uses requiring transparency is required as a sheet substrate (e.g., for use in overhead projector) or uses in which transfer is effected with heat on an article such as card, cloth, etc., it is possible to plaster a support coated with a tackifier on the surface opposite to the receiving layer of the transparent film or a white film, a foamed film, a synthetic or cellulose fiber paper as the material for imparting shielding property. Further, a sheet substrate formed by plastering mutually plastic films, mutually synthetic papers or mutually cellulose fiber papers with an adhesive can be used.

In forming the receiving layer, it is formed by coating an ink composition for formation of receiving layer prepared from a resin for formation of receiving layer with a solvent, etc. on a sheet substrate by a coating means known in the art, followed by drying. The thickness of the receiving layer may be preferably 1 to 50 μm. When the image-receiving sheet comprises the receiving layer alone, one having its thickness of 30 μm or more is preferred.

The image-receiving sheet in the present invention can provide an intermediate layer comprising a cushioning layer, a porous layer, etc. between the sheet substrate and the receiving layer, and by provision of such intermediate layer, an image corresponding to the image information with little noise can be transfer recorded with good reproducibility. As the material constituting the intermediate layer, for example, urethane resin, acrylic resin, ethylenic resin, butadiene rubber, epoxy resin, etc. may be included. The thickness of the intermediate layer may be preferably about 2 to 20 μm.

Also, the image-receiving sheet in the present invention can incorporate a release agent in the receiving layer for improvement of peelability from the heat transfer sheet. As the release agent, solid waxes such as polyethylene wax, amide wax, Teflon powder, etc.; fluorine type, phosphoric acid ester type surfactants; silicone oils, etc. may be included, but silicone oils are preferred.

As the above-mentioned silicone oil, oily ones can be also used, but those of cured type are preferred. As the cured type silicone oils, there may be included the reaction cured type, the photocured type, the catalyst cured type, etc., particularly preferably the reaction cured type silicone oils. As the reaction cured type silicone oil, those obtained by the reaction curing between an amino-modified silicone oil and an epoxy-modified silicone oil are preferable, and as the amino-modified silicone X-22-3050C (manufactured by Shinetsu Kagaky Kogyo K.K., Japan), etc. may be employed, and as the epoxy-modified silicone oil, X-22-3000E (manufactured by Shinetsu Kagaku Kogyo K.K.), etc. may be employed. As the catalyst cured type or photocured type silicone oil, KS-705F-PS (catalyst cured type silicone oil, manufactured by Shinetsu Kagaku Kogyo K.K.), KS-720 (photocured type silicone oil, manufactured by Shinetsu Kagaku Kogyo K.K.), etc. may be employed. The amount of these cured type silicone oils adds may be preferably about 0.5 to 30 parts by weight based on 100 parts by weight of the resin constituting the receiving layer.

Also, in the present invention, a release agent layer can be provided by coating a solution or a dispersion of the above-mentioned release agent in an appropriate solvent on the surface of the receiving layer, followed by drying. As the release agent constituting the release agent layer, the reaction cured product of the amino-modified silicon oil and the epoxy-modified silicone oil as described above is particularly preferable. The thickness of the release layer may be preferably 0.01 to 5 μm, particularly 0.05 to 2 μm.

Further, the image-receiving sheet in the present invention can provide a lubricating layer on the back of the sheet substrate. In some cases, image-receiving sheets are piled up and transfer is performed by delivering one sheet by one sheet, and in such cases, provision of a lubricating layer makes sliding mutually between the sheets smooth, whereby each sheet can be delivered accurately. As the material for the lubricating layer, methacrylate resins of methyl methacrylate, etc. or corresponding acrylate resins, vinyl type resins such as vinyl chloride-vinyl copolymer, etc. may be employed.

Also, an antistatic agent can be incorporated in the image-receiving sheet. By incorporation of the antistatic agent, there is the effect of preventing the image-receiving sheet from attachment of dust. The antistatic agent may be contained in the sheet substrate or the image-receiving layer, or can be also provided as the antistatic agent layer on the back of the sheet substrate, etc., but preferably as the antistatic agent layer on the back of the sheet substrate.

It is also possible to provide a detection mark on the image-receiving sheet. The detection mark is very convenient in performing registration between the heat transfer sheet and the image-receiving sheet, etc. and, for example, a detection mark detectable by a photoelectric tube detection means can be provided on the back of the sheet substrate by way of printing, etc.

The present invention is described in more detail below by referring to Examples. In the following description, "parts" indicates parts by weight.

EXAMPLES 1-2, COMPARATIVE EXAMPLES 1-2

(Preparation of heat transfer sheet)

On a substrate comprising a polyethylene terephthalate film (Toray K.K., Japan: Lumilar 5A-F53) with a thickness of 4.5 μm, an ink composition for formation of a heat-resistant lubricant layer comprising the composition shown below was coated to a thickness of 1 μm on drying, followed by drying and curing at 60° C. for 72 hours, to form a heat-resistant lubricant layer.

Ink composition for formation of heat-resistant lubricant layer

Polyvinyl butyral resin (Sekisui Kagaku K.K., Japan: Ethlec BX-1): 1.8 parts
Isocyanate (45% solution) (Dainippon Ink Kagaku, Japan: Perknock D-750): 7.9 parts
Phosphoric acid ester (Daiichi Kogyo Seiyaku, Japan: Plysurf A-208S): 1.3 parts
Phosphoric acid ester sodium salt (Toho Kagaku, Japan: Gafac RD-720): 0.54 part
Talc (Nippon Talc K.K., Japan: Microace L-1): 0.36 part
Toluene: 44.04 parts
Methyl ethyl ketone: 44.04 parts Next, on the opposite surface of the substrate, an ink composition for formation of dye layer having the following composition was coated by use of Myer bar #10 to a thickness on drying of 1 μm and dried at 80° C. for 5 minutes to form a dye layer, thus giving a heat transfer sheet 1. Also, for measurement of dye diffusion coefficient, coating was performed to a thickness of 5 μm.

Ink composition 1 for formation of dye layer

Magenta dye: No. 13 (the following formula): 3.00 parts

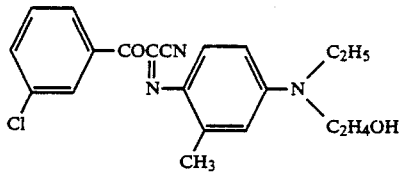

Polyvinyl acetoacetal resin (Sekisui Kagaku K.K., Japan: BV-5): 3.20 parts
Polyvinyl acetoacetal resin (Sekisui Kagaku K.K., Japan: BV-1): 0.30 parts
Toluene: 46.75 parts
Methyl ethyl ketone: 46.75 parts (Preparation of image-receiving layer)

The respective ink compositions for formation of receiving layer comprising the compositions shown below by use of various resins for formation of receiving layer were each coated on a synthetic paper with a thickness of 150 μm by wire bar coating to a thickness after drying of 6 μm, and dried at 100° C. for 15 minutes to provide an image-receiving sheet. By use of this, saturated transfer ratio, reflective color density, relative printing density were measured.

Also, the same respective ink composition for receiving layer as described above were each coated on a stretched polypropylene film with a thickness of 60 μm in place of the above synthetic paper and dried, followed by peel-off from the substrate, to obtain an image-receiving sheet with a thickness of 6 μm for measuring the dye diffusion coefficient as described below. Seven sheets of this were superposed on one another for measurement of the dye diffusion coefficient according to the measurement method (A).

Further, the same ink compositions for formation of the respective receiving layers were each coated and dried on a polyethylene terephthalate film (Toray K.K., Japan) with a thickness of 100 μm to a film thickness after drying of 100 to 500 μm to obtain an image-receiving sheet for measurement of the dye diffusion coefficient according to the measurement method (B).

Ink composition for formation of receiving layer (Example 1)

Resin for formation of receiving layer
Vinyl chloride-vinyl acetate copolymer (Denki Kagaku K.K.: 1000 A): 20 parts
Amino-modified silicone oil (Shinetsu Kagaku K.K.: X-22-3050C): 2 parts
Epoxy-modified silicone oil (Shinetsu Kagaku K.K.: X-22-3000E): 2 parts
Toluene: 38 parts
Methyl ethyl ketone: 38 parts Ink composition for formation of receiving layer (Example 2)

Resin for formation of receiving layer
Polyester resin (Arakawa Kagaku K.K.: KA-1039U18): 20 parts
Amino-modified silicone oil (Shinetsu Kagaku K.K.: X-22-3050C): 2 parts
Epoxy-modified silicone oil (Shinetsu Kagaku K.K.: X-22-3000E): 2 parts
Toluene: 38 parts
Methyl ethyl ketone: 38 parts Ink composition for formation of receiving layer (Comparative Example 1)

Resin for formation of receiving layer
Polymethyl methacrylate resin (Mitsubishi Rayon K.K.: Dianal BR-85): 15 parts
Amino-modified silicone oil (Shinetsu Kagaku K.K.: X-22-3050C): 1.5 parts
Epoxy-modified silicone oil (Shinetsu Kagaku K.K.: X-22-3000E): 1.5 parts
Toluene: 40 parts
Methyl ethyl ketone: 40 parts Ink composition for formation of receiving layer (Comparative Example 2)

Resin for formation of receiving layer
SBR (Shell Chemical: Kaliflex TR1101): 20 parts
Amino-modified silicone oil (Shinetsu Kagaku K.K.: X-22-3050C): 2 parts
Epoxy-modified silicone oil (Shinetsu Kagaku K.K.: X-22-3000E): 2 parts
Toluene: 38 parts
Methyl ethyl ketone: 38 parts (Measurement of dye transfer ratio and dye diffusion coefficient)

Of the respective image-receiving sheets obtained above, by use of the respective image-receiving sheets with the synthetic paper as the substrate, saturate transfer ratio was measured according to the measurement method as described above. Also, a stretched propylene film was prepared as the substrate.

By use of each image-receiving sheet, the dye diffusion coefficient was measured according to the measurement method (A) as described above, and also by use of each image-receiving sheet prepared with the PET film as the substrate, the dye diffusion coefficient (B) was measured. Those results are shown in Table 1.

(Printing test)

Initially, by using the image-receiving sheet with the synthetic paper as the substrate prepared in Example 1, and combining this with the above heat transfer sheet 1, printing was performed under the printing conditions shown below with a thermal head (Kyocera: KMT-85-6MPD2-STV), and the value of the applied pulse width was determined when the reflective color density of magenta measured by a color densitometer (Macbeth: RD-918) became approximately 1.0.

Printing conditions

Printing speed: 33.3 msec./line
Printing pulse width: 1–16 msec.
Head application voltage: 12.0 V
Delivery pitch: 0.167 mm
Dot density: 6 dots/mm The printing pulse width was defined to the value of the printing pulse width when the reflective color density determined as described above became approximately 1.0, and otherwise under the above printing conditions, printing was performed by use of the image-receiving sheets of other Examples and Comparative Examples.

The reflective color densities of magenta of other Examples and Comparative Examples were respectively measured under the printing conditions, and the respective measured values were represented as relative printing density (reflective color density/reflective color density of Example 1). Those results are also shown in Table 1.

On the other hand, by combining the image-receiving sheets prepared in Examples 1, 2 and Comparative Example 1 and the transfer sheets 2 to 6 prepared by use of the ink compositions 2 to 6 for formation of dye layer shown below according to the same method as in preparation of the ink composition 1 for formation of dye layer, the saturated dye transfer ratio, the reflective color density and the relative printing density at 120° C. were determined according to the methods as described above. The results are shown in Table 2.

The reflective color density of yellow was measured for the combinations with the heat transfer sheet 2, that of magenta for the combinations with the heat transfer sheet 3 and that of cyan for the combinations with the heat transfer sheet 4, 5 and 6.

Ink composition 2 for formation of dye layer

Dye:
FORON BRILLIANT YELLOW S-6GL (SANDOZ): 3.00 parts
Polyvinyl acetoacetal resin (Sekisui Kagaku K.K.: BV-5): 3.20 parts
Polyvinyl acetoacetal resin (Sekisui Kagaku K.K.: BV-1): 0.30 part
Toluene: 46.75 parts
Methyl ethyl ketone: 46.75 parts Ink composition 3 for formation of dye layer Disperse dye:
C.I. SOLVENT RED 19: 3.00 parts
Polyvinyl acetoacetal resin (Sekisui Kagaku K.K.: BV-5): 3.20 parts
Polyvinyl acetoacetal resin (Sekisui Kagaku K.K.: BV-1): 0.30 part
Toluene: 46.75 parts
Methyl ethyl ketone: 46.75 parts Ink composition 4 for formation of dye layer Disperse dye:
C.I. SOLVENT BLUE 63: 3.00 parts
Polyvinyl acetoacetal resin (Sekisui Kagaku K.K.: BV-5): 3.20 parts
Polyvinyl acetoacetal resin (Sekisui Kagaku K.K.: BV-1): 0.30 part
Toluene: 46.75 parts
Methyl ethyl ketone: 46.75 parts Ink composition 5 for formation of dye layer Cyan dye: No. 15 (the following formula): 3.00 parts

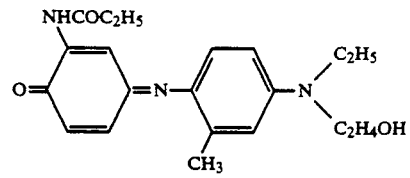

Polyvinyl acetoacetal resin (Sekisui Kagaku K.K., Japan: BV-5): 3.20 parts
Polyvinyl acetoacetal resin (Sekisui Kagaku K.K., Japan: BV-1): 0.30 parts
Toluene: 46.75 parts
Methyl ethyl ketone: 46.75 parts Ink composition 6 for formation of dye layer Cyan dye: No. 14 (the following formula): 3.00 parts

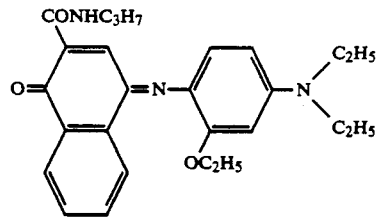

Polyvinyl acetoacetal resin (Sekisui Kagaku K.K., Japan: BV-5): 3.20 parts
Polyvinyl acetoacetal resin (Sekisui Kagaku K.K., Japan: BV-1): 0.30 parts
Toluene: 46.75 parts
Methyl ethyl ketone: 46.75 parts

TABLE 1

| | Dye diffusion coefficient ($cm^2$/min) | | Saturated transfer ratio of dye (%) | Reflective color density | Relative printing density |
|---|---|---|---|---|---|
| | Method (A) | Method (B) | | | |
| Example 1 | 2.0~6.0 E-08 | 1.2 E-08 | 72.2 | 0.92 | 1.00 |
| Example 2 | 0.6~1.2 E-07 | 6.8 E-08 | 80.8 | 1.00 | 1.08 |
| Com- | 2.0~4.0 E-08 | 6.2 E-09 | 24.7 | 0.43 | 0.47 |

TABLE 1-continued

| | Dye diffusion coefficient ($cm^2$/min) | | Saturated transfer ratio of dye (%) | Reflective color density | Relative printing density |
|---|---|---|---|---|---|
| | Method (A) | Method (B) | | | |
| parative Example 1 | | | | | |
| Comparative Example 2 | 1.2~4.0 E-09 | 1.3 E-07 | 37.2 | 0.51 | 0.55 |

TABLE 2

| Heat transfer sheet | Image-receiving sheet | Saturated transfer ratio of dye (%) | Reflective color density | Relative printing density |
|---|---|---|---|---|
| 2 | Example 1 | 52.8 | 1.04 | 1.00 |
| | Example 2 | 60.0 | 1.26 | 1.21 |
| | Comparative Example 1 | 21.7 | 0.64 | 0.62 |
| 3 | Example 1 | 65.6 | 0.99 | 1.00 |
| | Example 2 | 70.8 | 1.19 | 1.20 |
| | Comparative Example 1 | 2.7 | 0.16 | 0.16 |
| 4 | Example 1 | 74.1 | 1.00 | 1.00 |
| | Example 2 | 81.0 | 1.24 | 1.24 |
| | Comparative Example 1 | 6.3 | 0.35 | 0.35 |
| 5 | Example 1 | 76.0 | 1.08 | 1.00 |
| | Example 2 | 81.5 | 1.19 | 1.10 |
| | Comparative Example 1 | 5.7 | 0.39 | 0.36 |
| 6 | Example 1 | 69.4 | 1.02 | 1.00 |
| | Example 2 | 71.6 | 1.25 | 1.23 |
| | Comparative Example 1 | 8.2 | 0.51 | 0.50 |

As is apparent from the above Examples and Comparative Examples, according to the heat-sensitive transfer method, since transfer is effected by combining a heat transfer sheet and an image-receiving sheet so that the dye diffusion coefficient in the receiving layer at 120° C. may be $5\times10^{-9}$ $cm^2$/min and the saturated transfer ratio of the dye at 120° C. may be 40% or more, it is possible to effect transfer capable of giving a desired printing density within a short time without extension of printing time even with a relatively smaller application of energy, and yet good transfer can be effected with small printing energy, whereby there is the effect of reducing the power consumed, etc.

Utilizability in Industry

The present invention can be widely applied to heat-sensitive recording systems which perform image formation by use of dot heating means such as thermal head, current passage head and laser beam.

I claim:

1. A heat-sensitive transfer method which performs heat-sensitive transfer recording by heating (a) a heat transfer sheet comprising a dye layer comprising a dye and a binder formed on a substrate, and (b) an image-receiving sheet comprising a receiving layer comprising a resin for receiving the dye migrating from the dye layer on said heat transfer sheet formed on a substrate according to image information from the back of the heat transfer sheet with said dye layer and receiving layer being superposed on each other, whereby the dye migrates into the receiving layer, said dye constituting the dye layer of said heat transfer sheet having a dye diffusion coefficient in the receiving layer of $5\times10^{-9}$ $cm^2$/min. or higher at 120° C. when the dye is diffused by migration into the receiving layer of said image-receiving sheet, and the image-receiving sheet and the heat transfer sheet being used in combination so that the saturated transfer ratio of the dye from the dye layer to the receiving layer is 40% or more at 120° C. when the dye constituting the dye layer of said heat transfer sheet is transferred to the receiving layer of said image-receiving sheet.

2. A method according to claim 1, wherein the dye in the dye layer of said heat transfer sheet is dissolved in a binder.

3. A method according to claim 1, wherein the dye layer of said heat transfer sheet is formed with dyes of a plurality of hues formed by applying the dyes separately from each other onto a single substrate.

4. A method according to claim 1, wherein the dye constituting the dye layer of said heat transfer sheet comprises a sublimable dye having a molecular weight of 150 to 800.

5. A method according to claim 1, wherein said dye diffusion coefficient is $1\times10^{-8}$ $cm^2$/min. or higher at 120° C.

6. A combination for heat transfer recording comprising (a) a heat transfer sheet comprising a dye layer comprising a dye and a binder formed on a substrate, and (b) an image-receiving sheet comprising a receiving layer comprising a resin for receiving the dye migrating from the dye layer on said heat transfer sheet formed on a substrate for performing heat transfer recording by heating said combined product of heat transfer sheet-image-receiving sheet according to image information from the back of the heat transfer sheet with said dye layer and receiving layer being superposed on each other, whereby the dye migrates into the receiving layer, said dye constituting the dye layer of said heat transfer sheet having a dye diffusion coefficient in the receiving layer of $5\times10^{-9}$ $cm^2$/min. or higher at 120° C. when the dye is diffused by migration into the receiving layer of said image-receiving sheet, and the image-receiving sheet and the heat transfer sheet being used in combination so that the saturated transfer ratio of the dye from the dye layer to the receiving layer is 40% or more at 120° C. when the dye constituting the dye layer of said heat transfer sheet is transferred to the receiving layer of said image-receiving sheet.

7. A combination according to claim 6, wherein the dye in the dye layer of said heat transfer sheet is dissolved in a binder.

8. A combination according to claim 6, wherein the dye layer of said heat transfer sheet is formed with dyes of a plurality of hues formed by applying the dyes separately from each other onto a single substrate.

9. A combination according to claim 6, wherein the dye constituting the dye layer of said heat transfer sheet comprises a sublimable dye having a molecular weight of 150 to 800.

10. A combination according to claim 6, wherein the substrate also functions as the receiving layer in said image-receiving sheet.

11. A combination according to claim 6, wherein said dye diffusion coefficient is $1\times10^{-8}$ $cm^2$/min. or higher at 120° C.

* * * * *